US007481395B2

(12) United States Patent
Rogers

(10) Patent No.: US 7,481,395 B2
(45) **Date of Patent: *Jan. 27, 2009**

(54) WIPES CONTAINER HOLDER

(75) Inventor: Anthony Rogers, Holland, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/034,826

(22) Filed: Feb. 21, 2008

(65) Prior Publication Data

US 2008/0135675 A1 Jun. 12, 2008

Related U.S. Application Data

(63) Continuation of application No. 11/592,351, filed on Nov. 3, 2006, now Pat. No. 7,357,350.

(51) Int. Cl.
*B65H 75/02* (2006.01)

(52) U.S. Cl. ..... 242/594.5; 242/598.3

(58) Field of Classification Search ..... 242/594.1, 242/594.5, 598.3, 599.1, 595, 595.1, 596.8, 242/597.8, 598.6, 560, 560.2; 206/233, 409; 312/34.8

See application file for complete search history.

(56) References Cited

U.S. PATENT DOCUMENTS

| | | | |
|---|---|---|---|
| 3,837,595 | A | 9/1974 | Boone |
| 3,943,859 | A | 3/1976 | Boone |
| 4,106,616 | A | 8/1978 | Boone |
| 4,106,617 | A | 8/1978 | Boone |
| 4,235,333 | A | 11/1980 | Boone |
| 4,641,898 | A | 2/1987 | Horowitz et al. |
| 4,834,316 | A | 5/1989 | Delorean |
| 4,978,095 | A | 12/1990 | Phillips |
| 5,618,008 | A | 4/1997 | Dearwester et al. |
| 5,897,074 | A | 4/1999 | Marino |
| 5,950,960 | A | 9/1999 | Marino |

(Continued)

FOREIGN PATENT DOCUMENTS

| | | |
|---|---|---|
| CH | 679114 | 12/1991 |

(Continued)

OTHER PUBLICATIONS

Internet Search Results http://www.gnpd.com Mintel Moist Toilet Roll Product Description and Image dated Jul. 20, 2006.

*Primary Examiner*—William A Rivera
(74) *Attorney, Agent, or Firm*—Charles R. Matson

(57) ABSTRACT

A bathroom accessory adapted to connect with a bathroom tissue roll trunnion and support a container of wipes is disclosed. The bathroom accessory may include first and second brackets connected with and extending upward from a base. The first and second brackets can be adapted to connect with a tissue trunnion, and the base can be adapted to support a container of wipes thereon. Embodiments of the bathroom accessory can be configured structural features to provide a keyed engagement a wipe container to help ensure that a particular type of wipe container is used with the wipe container holder. Other embodiments include features that may help secure the wipe container in a particular position on the wipe container holder. Further, embodiments of the wipe container holder can also be used when toilet training an individual.

14 Claims, 5 Drawing Sheets

U.S. PATENT DOCUMENTS

| | | | |
|---|---|---|---|
| D417,351 | S | 12/1999 | Scavuzzo |
| 6,189,730 | B1 | 2/2001 | Mcclymonds |
| 6,446,808 | B1 | 9/2002 | Paul et al. |
| 6,626,395 | B1 | 9/2003 | Newman et al. |
| 6,702,227 | B1 | 3/2004 | Newman et al. |
| 6,959,890 | B1 | 11/2005 | Breitinger |
| 6,997,342 | B2 | 2/2006 | Mitchell et al. |
| 7,128,235 | B2 | 10/2006 | Haddad et al. |
| 7,140,513 | B2 | 11/2006 | Welchel et al. |
| 7,357,350 | B1 * | 4/2008 | Rogers ..... 242/594.5 |
| 2004/0120988 | A1 | 6/2004 | Masting |
| 2004/0206651 | A1 | 10/2004 | Saito et al. |

FOREIGN PATENT DOCUMENTS

| | | | |
|---|---|---|---|
| DE | 20111356 | U1 | 2/2002 |
| GB | 2270901 | A | 3/1994 |
| GB | 2357076 | A | 6/2001 |
| WO | WO 96/09789 | A1 | 4/1996 |

* cited by examiner

WIPES CONTAINER HOLDER

CROSS REFERENCE TO RELATED APPLICATION

This application is a continuation of U.S. application Ser. No. 11/592,351, filed Nov. 3, 2006, now U.S. Pat. No. 7,357,350, which is hereby incorporated by reference.

FIELD OF THE INVENTION

The present disclosure relates to bathroom accessories, and more particularly, to bathroom accessories adapted to connect with bathroom tissue roll trunnions and support containers of wipes.

BACKGROUND OF THE INVENTION

Various types of wipes are generally known in the art. Wet wipes are often used in hygienic applications to clean waste or other material from a body surface. For example, some wet wipes may be used for cleaning hands, for cleaning small children and infants when changing diapers, or as a bath tissue (e.g. instead of toilet paper). In some instances, a plurality or stack of wet wipes is sized for storage inside a container, sometimes in the form of a plastic tub with a hinged lid on the top. The lid may be opened to remove an individual wet wipe sheet. Once the plurality of wipes is used, the container may be replaced or restocked with replacement wipes.

During the early years of life, young boys and girls begin the toilet training process, perhaps under the direction of a parent or other care provider. The toilet training process involves a number of different aspects. One such aspect includes providing instruction and encouragement to a youngster to wipe with bathroom tissue (e.g. toilet paper) after using a toilet. The use of disposable (e.g. flushable) wet wipes may be a useful teaching aid in this particular aspect of toilet training to help a youngster transition to using conventional toilet paper held on a roll. For example, disposable wet wipes may be provided in predetermined sizes to help provide guidance to a youngster as to the desired amounts of toilet paper to be used. In addition, wet wipes may be treated with chemicals, soaps, and the like to provide for better hygiene and as well as compensating for a youngster's potential lack of experience with the wiping process.

As the use of wet wipes becomes more widespread, there is an increased likelihood that replacement wipes used to refill a container may originate from a source different than that of the original wipes. The consumer may experience harmful or costly consequences when the replacement wipes significantly differ from the original wipes. For example, if the original wipes are suitable for disposal in a toilet while the replacement wipes are not, a consumer may damage his or her plumbing by disposing the replacement wipes in the toilet. In another scenario, discomfort and/or injury may occur when using a replacement wipe having a chemical composition or substrate structure that is different from the original. In yet another scenario, some inferior and/or differently configured replacement wipes may be supplied in containers that are substantially similar to the containers of the original wipes. In such an instance, when a consumer uses a similar replacement container housing a different, inferior replacement wipe, he or she may associate the undesirable refill wipe characteristics with the original container brand.

Various types of accessories have been designed that are adapted to support wipes and/or additional conventional rolls of toilet paper near a toilet. Some of these accessories can be connected with and/or near existing toilet tissue roll supports. However, some of these accessories do not provide for easy installation and removal. Further, some of these accessories are adapted to work with wipes and/or toilet paper from various different sources. Therefore, such accessories do not help prevent consumers from attempting to use wipe containers supplied with inferior and/or differently configured replacement wipes.

SUMMARY OF THE INVENTION

Aspects of the present disclosure involve a bathroom accessory adapted to connect with a bathroom tissue roll trunnion and support a container of wipes. The bathroom accessory may include first and second brackets connected with and extending upward from a base. The first and second brackets can be adapted to connect with a tissue trunnion, and the base can be adapted to support a container of wipes thereon. Embodiments of the bathroom accessory can be keyed to a wipe container to help ensure that a particular type of wipe container is used with the wipe container holder. Other embodiments include features that may help secure the wipe container in a particular position on the wipe container holder. Further, embodiments of the wipe container holder can also be used when toilet training an individual.

In one form, a bathroom accessory includes: a base; a first bracket connected with the base and including a first hook; a second bracket connected with the base and including a second hook; at least one structural feature adapted to provide a keyed engagement with a corresponding structural feature on a wipes container supported on the base; and wherein the first and second hooks are adapted to connect with a bathroom tissue roll trunnion.

In another form, a bathroom accessory includes: a base; at least one member connected with the base; a first bracket connected with the base, the first bracket including a first hook; a second bracket connected with the base, the second bracket including a second hook; wherein the first and second hooks are adapted to connect with a bathroom tissue roll trunnion; and wherein the at least one member is adapted to prevent movement of a wipes container supported on the base in at least one direction.

In yet another form, a bathroom accessory includes: a base; a ledge extending from the base; the ledge adapted to be received within a correspondingly shaped recess in a wipes container; a first bracket having a first end portion connected with the base and a second end portion including a first hook; a second bracket having a first end portion connected with the base and a second end portion including a second hook; and wherein the first and second hooks are adapted to connect with a bathroom tissue roll trunnion.

DETAILED DESCRIPTION OF THE INVENTION

Figure 1:
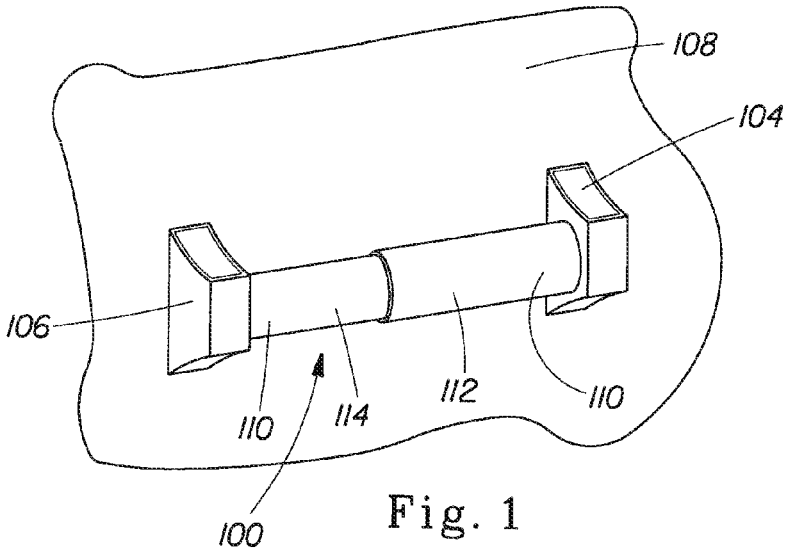
FIG. 1 is an isometric view of a bathroom tissue roll trunnion.

Aspects of the present disclosure involve a bathroom accessory in the form of a holder adapted to connect with a bathroom tissue roll trunnion and support a container of wipes. The wipe container holder may include first and second brackets connected with and extending upward from a base. As discussed in more detail below, the first and second brackets can be adapted to connect with a tissue trunnion, and the base can be adapted to support a container of wipes thereon. The base and brackets can be configured in various ways to connect with the tissue trunnion and to support the wipes container. As discussed in more detail below, the brackets may be configured allow a user to easily connect the wipe container holder with a tissue trunnion, while at the same time providing a secure connection thereto without interfering with a roll of tissue on the trunnion. For example, some embodiments of the first and second brackets can include hooks defining apertures adapted to receive opposing end portions of the trunnion such that a roll of bathroom tissue can be placed therebetween and freely rotate about the trunnion.

Embodiments of the base and/or brackets may also be configured to engage containers of wipes having various features, which may help prevent the container from being easily bumped, pulled, or pushed from a position on the base, such as when extracting wipes from the container. In addition, the wipe container holder and the wipe container may be keyed to each other to help encourage the use of a particular type of wipe container with the wipe container holder. For example, the wipe container holder and the wipe container may each have corresponding structural features (e.g. a protrusion and a recess) adapted to engage each other. As such, the keyed engagement of the structural features may help prevent the use of incorrect wipe containers and/or may help prevent the use of wipe containers supplied with inferior and/or differently configured replacement wipes. In addition, the engagement between the wipe container and the wipe container holder may also allow a user to more easily remove and/or replace a wipe container on the wipe container holder.

As discussed in more detail below, embodiments of the wipe container holder can also be used when toilet training an individual. More particularly, the wipe container holder can be configured to help encourage and teach a youngster to wipe after using a toilet. In one example, the wipe container holder may be configured to support the wipes container at a height that is lower than the tissue trunnion, which may provide relatively easy access to the wipe container by a person, such as a child, while seated on a toilet. Placing disposable wipes near the toilet and/or near existing rolls of conventional toilet paper, may also be useful aid in the toilet training process to help a youngster make an association between wipes and conventional toilet paper. In another example, the wipe container holder can include indicia to attract the attention of and encourage the use of wipes by a youngster. Such indicia may be provided in various forms, such as anthropomorphic animals, cartoon characters, and the like. In yet another example, the wipe container holder can include various indicia to provide instruction and encouragement to an individual during the toilet training process. For instance, some indicia can provide instruction to an individual on to wipe after using the toilet.

Figure 4:
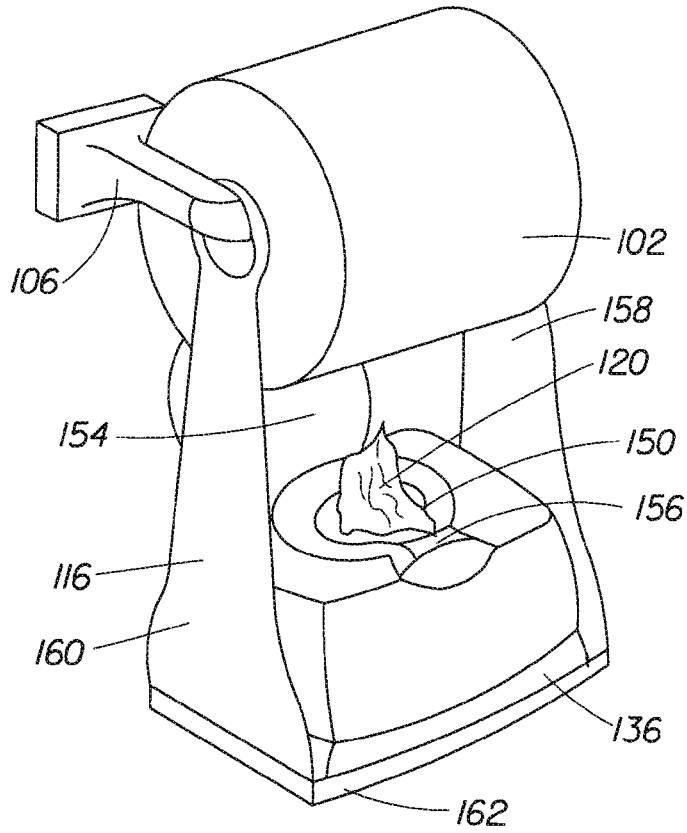
FIG. 4 is an isometric view of a bathroom tissue roll trunnion supporting one embodiment of a wipe container holder and a roll of bathroom tissue.

FIGS. 1 and 4 show examples of a bathroom tissue roll trunnion 100 adapted to support a roll of bathroom tissue 102. Tissue trunnions 100 are well known in the art and can be configured in various different ways. In the example shown in FIG. 1, the tissue trunnion 100 is connected between a first trunnion bracket 104 and a second trunnion bracket 106, which in turn, are connected with a fixed object, such as a wall 108. Tissue trunnions can be configured with cross sections having various different shapes and can be adapted to rotatably support a bathroom tissue roll. For example, the tissue trunnion 100 in FIG. 1 has a circular-shaped cross section. The tissue trunnion can also be placed in a location to support a roll of bathroom tissue near a toilet. In some instances, the tissue trunnion is located such that a user, while seated on a toilet, can easily reach a roll of toilet tissue rotatably supported on the tissue trunnion.

Tissue trunnions can also be configured in various different ways to allow a user to remove and replace bathroom tissue rolls. In some configurations, opposing end portions of the tissue trunnion are releasably connected with the first and second brackets. For example, in the tissue trunnion shown in FIG. 1, opposing end portions 110 of the trunnion 100 may be adapted to be received in corresponding recesses in the first and second trunnion brackets 104, 106. The tissue trunnion 100 may also include a first member 112 telescopically engaged with a second member 114. A spring may be housed inside the first member and the second member. The spring may be configured to force opposing end portions 110 of the tissue trunnion 100 against the first and second trunnion brackets 104, 106 to help hold the tissue trunnion in place. The tissue trunnion can be removed by disengaging one or both end portions 110 from the brackets 104, 106 by forcing one end portion of the trunnion toward the other end portion against the force of the spring. In other configurations, one end portion of the trunnion is fixedly connected with one of the trunnion brackets and the opposing end portion is releasably connected with another one of the trunnion brackets. As such, one or both end portions of the trunnion can be disconnected from one or both trunnion brackets to allow a user to remove a bathroom tissue roll from the trunnion, install a replacement bathroom tissue roll on the trunnion, and reconnect the tissue trunnion with one or both trunnion brackets. As discussed in more detail below, wipe container holders 116, such as shown in FIG. 4, of the present disclosure can be selectively connected with the tissue trunnion. As previous mentioned, tissue trunnions are well known in the art and it is to be appreciated that the wipe container holders described and claimed herein can be used with various different forms and configurations of tissue trunnions.

Figure 2:
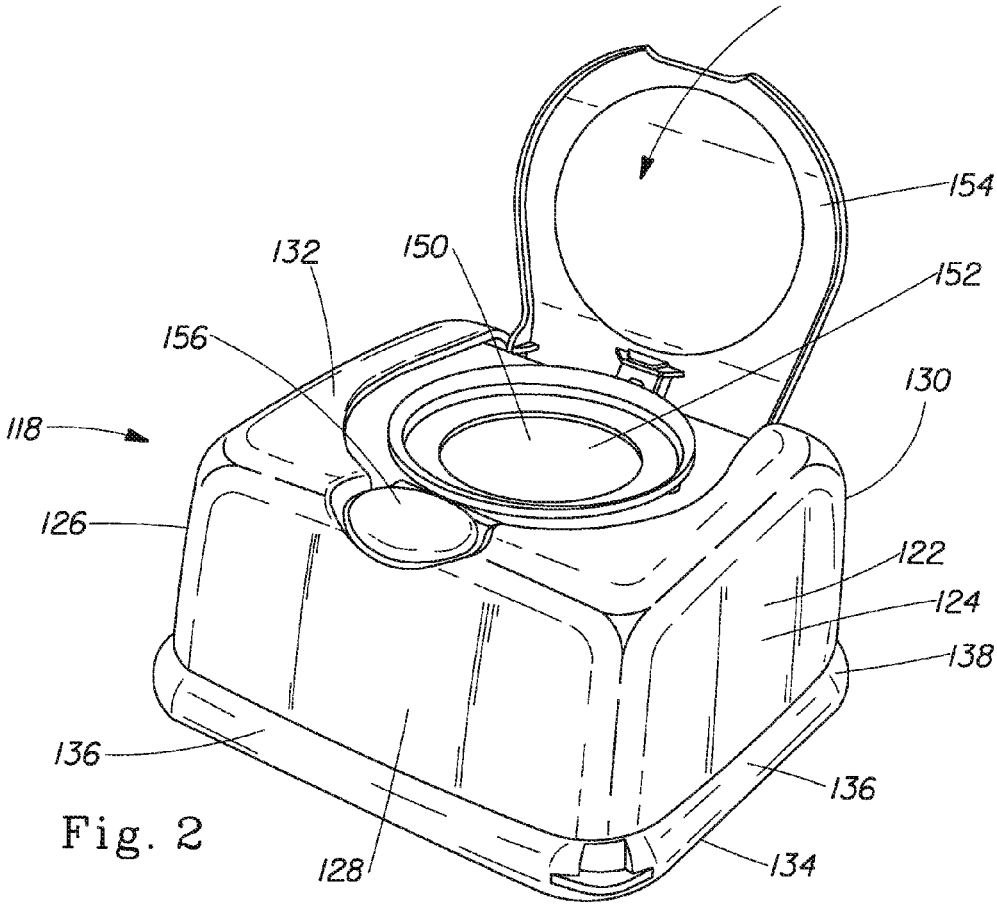
FIG. 2 is an isometric view of a wipes container.
Figure 3:
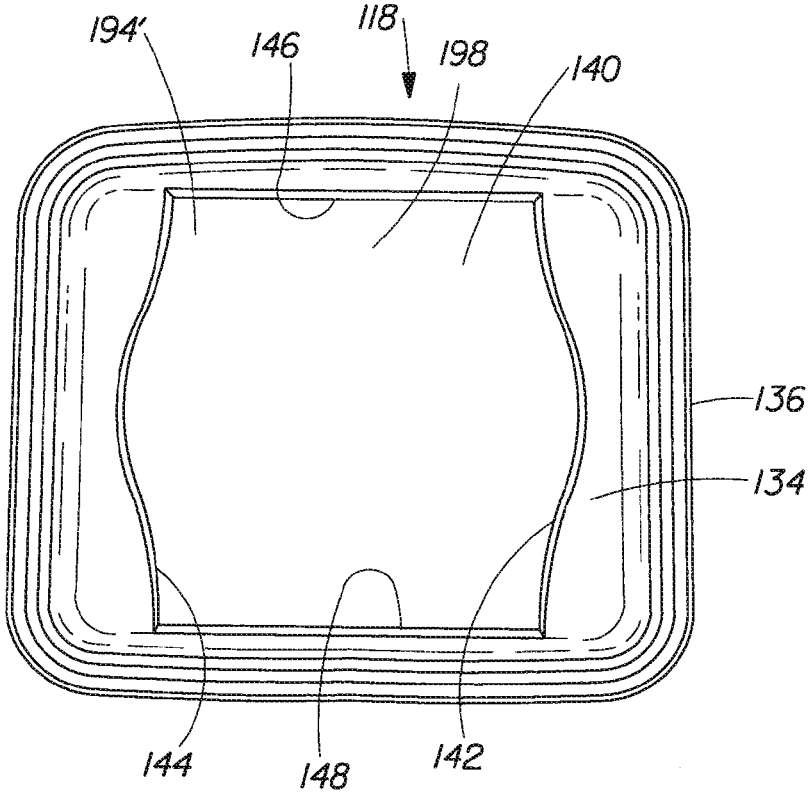
FIG. 3 is a bottom view of the wipes container of FIG. 2.

As previously mentioned, the present disclosure is related to various aspects of bathroom accessories in the form of holders adapted to support containers of wipes from a tissue trunnion. FIGS. 2-4 show one example of a wipe container 118 adapted to store wipes 120 and that may be used with the wipe container holders 116 of the present disclosure. The container 118 includes a main body 122 having a right side 124 and a left side 126 connected with and separated by a front side 128 and a rear side 130. The right, left, rear, and front sides of the container 118 are connected with and extend downward from a top side 132 to connect with a bottom side 134. In some container configurations, the bottom side 134 may be integrally formed with the right side 124, left side 126, front side 128, and rear side 130. In other configurations, the bottom side may be removably connected with the right, left, front, and rear sides. As shown in FIGS. 2 and 3, the container 118 includes a rim 136 with a convex outer surface 138 extending along the perimeter adjacent the intersection of the bottom side 134 with the right side 124, left side 126, front side 128, and rear side 130. In addition, the bottom side 134 includes a recess 140 defined by a first side wall 142 and a second side wall 144 connected with and separated by a third side wall 146 and a fourth side wall 148. As discussed in more detail below, embodiments of the wipe container holder may have various structural features adapted to engage structural features of the wipes container 118, such as the rim 136 and/or the recess 140, to help secure the wipes container on the wipe container holder 116. It is to be appreciated that other forms of containers having differently shaped sides may be used with the wipe container holders of the present disclosure.

As shown in FIGS. 2 and 4, the top side 132 of the container 118 includes an opening 150 providing access to an interior chamber 152, which may be adapted to store one or more wipes 120 therein. The opening 150 may be sized so that a wipe can pass therethrough, allowing a user to remove wipes from the interior chamber 152 of the wipes container 118. The wipes container may also include various different types and configurations of lids that selectively provide access to opening and cover the opening. For example as shown in FIG. 2, the container 118 includes a lid 154 that is pivotally connected with the main body 122 of the container. As shown in FIG. 2, the lid 154 may be pivoted upward to an open position to provide access to the opening 150. The lid 154 may also be pivoted downward in the direction shown to a closed position to cover the opening 150. The container 118 may also be provided with a latch 156 or other mechanism to selectively secure the lid in the closed position. It is to be appreciated that the container 118, lid 154, and latch 156 may be formed from various types of material, such as plastic.

It is to be appreciated that various different configurations and types of containers and wipes can be used with the wipe container holders described and claimed herein. It is also to be appreciated that wipes containers used with the holders of the present disclosure can be adapted to hold various types of wipes provided in various forms. For example, the wipes may be wet or dry and may be provided as single sheets stacked in a pouch or in a perforated roll. In addition, the wipes may be suitable for disposal in a toilet and may also be configured for hygienic and/or other purposes.

Figure 5:
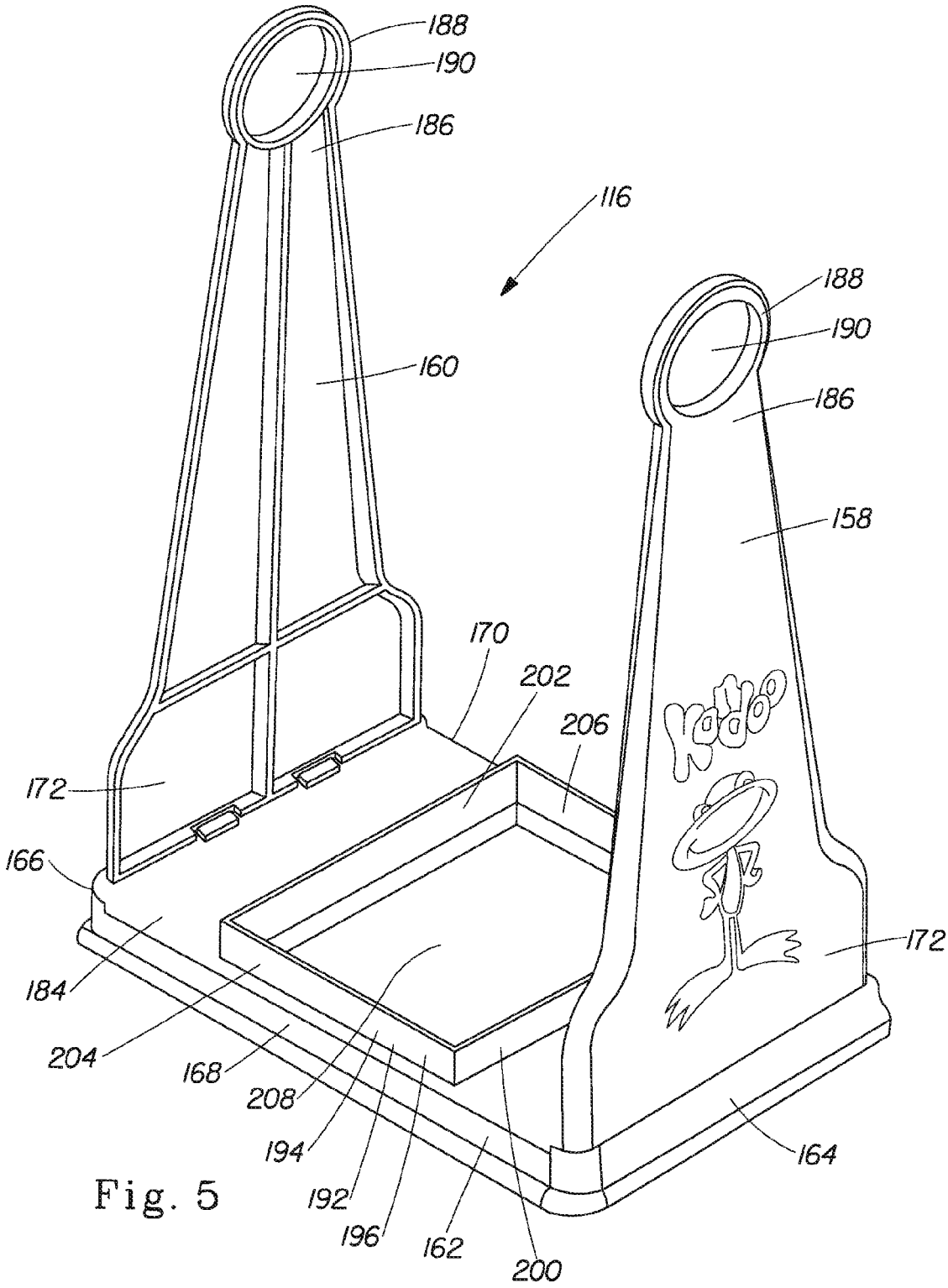
FIG. 5 is an isometric view of the wipe container holder shown in FIG. 4.
Figure 6:
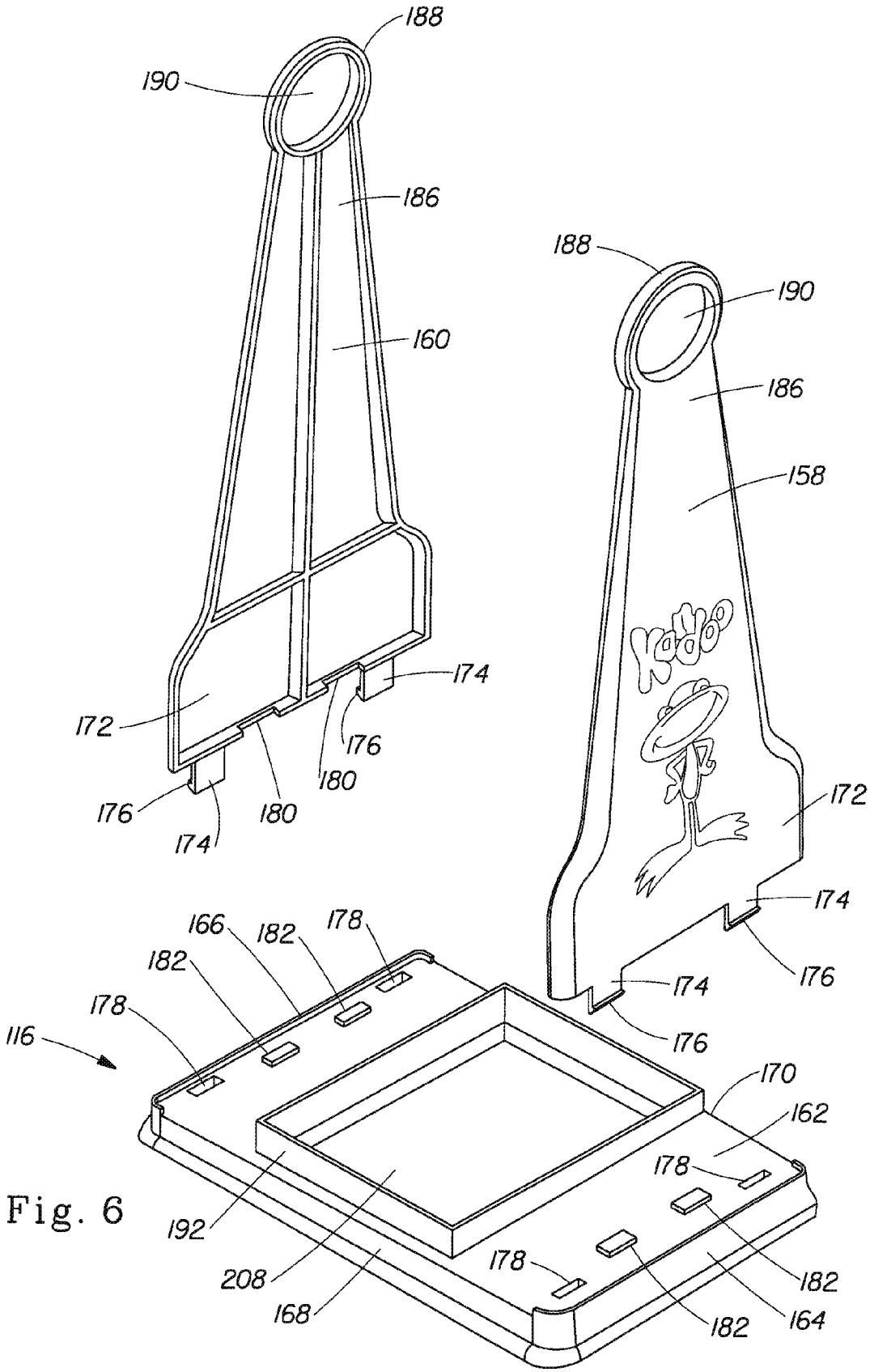
FIG. 6 is an assembly view of the wipe container holder shown in FIG. 5.

As previously mentioned, embodiments of wipe container holders are adapted to support containers of wipes from tissue trunnions. FIGS. 4-6 show one embodiment of the wipe container holder 116 adapted to support the wipe container 118 shown in FIGS. 2 and 3. As previously mentioned, the wipe container holder can support various different embodiments of wipe containers other than that which is illustrated in FIGS. 2 and 3. As shown in FIGS. 4-6, the wipe container holder 116 includes a first bracket 158 and a second bracket 160 connected with a base 162. The first bracket 158 and second bracket 160 are adapted to connect with tissue trunnions, such as the tissue trunnion 100 shown in FIG. 1. The base 162 is adapted to support wipes containers, such as the wipe container 118 shown in FIG. 2. As shown in FIG. 4, the wipe container holder 116 is configured such that the base supports 162 the wipes container 118 below the tissue trunnion 100.

As shown in FIGS. 5 and 6, the base 162 has a rectangular-shaped perimeter defined by a right side 164 and a left side 166 connected with and separated by a front side 168 and a rear side 170. First end portions 172 of the first and second brackets 158, 160 are connected adjacent the right side 164 and left side 166 of the base 162, respectively. In some embodiments, the brackets 158, 160 are formed integrally with the base 162. In other embodiments, the brackets are configured as separate members that can be connected with the base in various different ways, such as with adhesive, fasteners, and the like. In one example, as shown in FIG. 6, a pair of tangs 174 extends from the first end portion 172 of each bracket 158, 160. The tangs 174 each include a beveled edge 176 with an increased thickness that are adapted to be inserted into corresponding slots 178 with a snap-fit to connect the brackets 158, 160 with the base 162. The first end portions 172 of each bracket 158, 160 also include a pair of open slots 180 adapted to receive and engage corresponding tabs 182 extending upward from an upper surface 184 of the base 162.

As previously mentioned, the brackets 158, 160 are adapted to connect with the tissue trunnion 100 and support the base 162 and wipe container 118 therefrom. As shown in FIGS. 4-6, the first and second brackets 158, 160 extend from the upper surface 184 of the base 162 to second end portions 186, each including closed loop hooks 188 having an aperture 190. The hooks 188 on the brackets 158, 160 are adapted to receive the tissue trunnion 100. In a closed loop configuration, a user can connect the wipe container holder 116 by disconnecting the tissue trunnion 100 from whatever fixed object to which the tissue trunnion is connected, inserting the tissue trunnion 100 through the hooks 188, and reconnecting the tissue trunnion to the fixed object. It is to be appreciated that the wipe container holder 116 can be configured to define various distances between the hooks 188. In one example, the distance between the hooks is such that the hooks connect adjacent to opposing end portions of the tissue trunnion. The hooks may also be located adjacent to opposing end portions of a tissue roll supported on the tissue trunnion without interfering with ability of the tissue roll to freely rotate on the tissue trunnion. In other examples, the brackets are able to flex or bend inward toward each other or outward away from each other to accommodate different distance requirements between the hooks.

It is to be appreciated that embodiments of the wipe container holder can be configured with hooks having various sizes and shapes. For example, in one embodiment, the closed loop hooks have apertures defining inner diameters of 1.194 inches. In another embodiment, the wipe container holder is configured with open loop hooks. It should also be appreciated that the lengths of the first bracket and the second bracket can be varied in different embodiments. For example, the brackets may sized to place the wipe container at a height that allows a relatively small person, such as a child, to more easily access the wipe container while seated on a toilet. Locating the wipe container at a relatively low height can be useful during the toilet training process, because the lower height location may make it easier for a toddler to reach and extract wipes from the wipe container while seated on a toilet. In another example, the first and second brackets may be sized such that the wipes container is held far enough below a roll of bathroom tissue on the tissue trunnion to allow the lid on the wipe container to pivot upward without being impeded by a roll of bathroom tissue. In one embodiment, the wipe container holder is configured to define a distance of 8.407 inches between the upper surface of the base and a center of the apertures in the closed loop hooks.

As previously mentioned, wipe container holders may also be adapted to engage wipes containers to help secure the wipes containers on the base and/or help prevent the use of wipe containers containing replacement wipes from a different source. For example, as shown in FIGS. 5 and 6, the base 162 of the wipe container holder 116 includes a ledge 192 adapted to engage the recess 140 on the wipes container 118 shown in FIG. 3. In such a configuration, the ledge 192 may function as a structural feature 194 acting as a key member 196 and the recess 140 may function as a corresponding structural feature 194' in acting as a keyway 198. The keyed engagement between the wipe container holder 116 and the wipe container 118 may help ensure that a user does not replace the wipe container with a differently configured wipe container. The keyed engagement may also help a user place the wipe container 118 on the base 162 in a particular orientation and/or particular position. It is to be appreciated that the perimeter of the ledge 192 may be sized to define a relatively loose or snug fit within the recess 140.

As shown in FIG. 5, the ledge 192 extends upward from the upper surface 184 of the base 162 and defines a quadrilateral perimeter having a first side wall 200, a second side wall 202, a third side wall 204, and a fourth side wall 206. When the wipe container 118 is placed on the base 162, the ledge 192 is received within the recess 140 in the bottom side 134 of the wipe container 118 such that the ledge side walls (200, 202, 204, 206) are positioned adjacent to corresponding recess side walls (142, 144, 146, 148). The engagement between the corresponding side walls of the ledge 192 and the recess 140 helps to resist forces exerted on the wipe container 118 in directions parallel to the upper surface 184 of the base 162 while at the same time allowing the wipe container 118 to be easily lifted from the base 162. As such, the keyed engagement helps prevent the wipe container 118 from easily being bumped, pulled, or pushed along the upper surface 184 of the base 162. As shown in FIG. 5, the base 162 may also include an aperture 208 inside the perimeter of the ledge 192. The aperture 208 may allow a user to more easily engage the bottom side 134 of the wipe container 118 when removing and/or placing the wipe container 118 on the base 162. The aperture 208 may also allow the base 162 to be constructed from relatively less material.

Although the wipe container is shown and described as having the keyway 198 in the form of the recess 140 and the wipe container holder 116 is shown and described as having the key member 196 the form of the ledge 192, other embodiments the wipe container may include a ledge or key member adapted to be received within a recess or keyway within the container holder. It should also be appreciated that the wipe container and/or container holder may include one or more key members and/or keyways of various sizes. For example, in one embodiment, the ledge extends approximately 0.375 inches outward from the upper surface of the base and defines a rectangle having a width of approximately 3.026 inches and a length of approximately 3.774 inches. It is also to be appreciated that the wipe container and/or container holder may include one or more key members and/or key ways that can be configured to define various different geometric shapes, such as squares, rectangles, circles, ovals, ellipses, triangles, stars, and/or combinations thereof.

Figure 7:
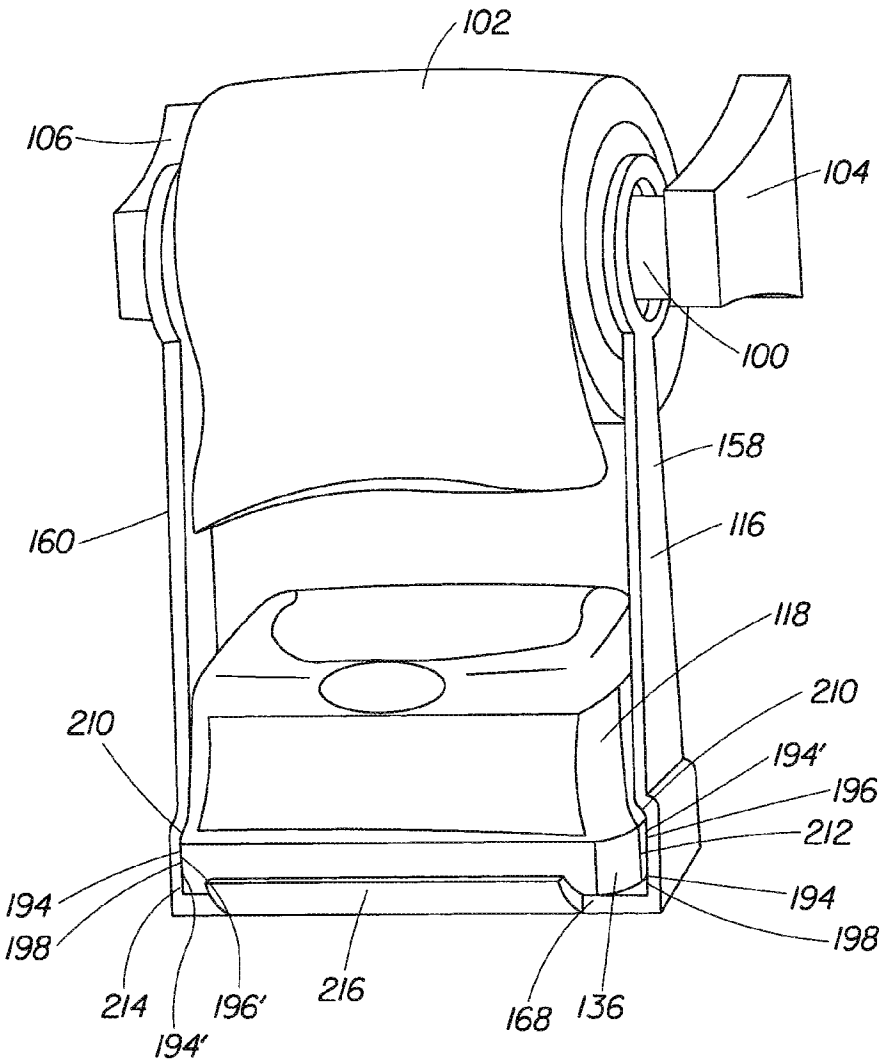
FIG. 7 is an isometric view of a bathroom tissue roll trunnion supporting a second embodiment of a wipe container holder and a roll of bathroom tissue.
Figure 8:
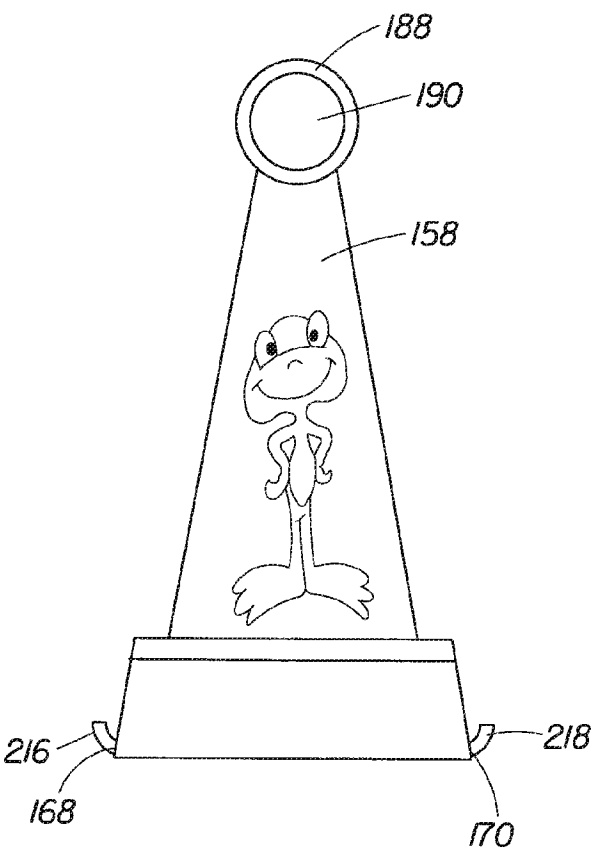
FIG. 8 is a right side view of the wipe container holder shown in FIG. 7.

As mentioned above, embodiments of the wipes container holder can be configured in various ways to engage and/or connect with different wipe containers. For instance, FIGS. 7 and 8 show a second embodiment of wipe container holder 116 adapted to support a wipe container 118. As with the first wipe container holder embodiment discussed above, the wipe container holder of the second embodiment is adapted to connect with tissue trunnions, such as the tissue trunnion 100 shown in FIG. 1. However, the second embodiment of wipe container holder differs from the first embodiment in various ways. For example, as discussed in more detail below with reference to FIGS. 7 and 8, the second embodiment of the wipe container holder 116 is keyed to the wipe container 118 through corresponding structural features 194, 194' on the brackets 158, 160 and the rim 136.

As shown in FIGS. 7 and 8, the wipe container holder 116 includes first and second brackets 158, 160 connected with the base 162. As discussed above with reference to the first embodiment, the first and second brackets 158, 160 include closed loop hooks 188 and are adapted to connect with the tissue trunnion 100. The base 162 is adapted to support the wipes container 118 thereon. The base 162 also has a rectangular-shaped perimeter defined by right and left sides 164, 166 connected with and separated by front and rear sides 168, 170. The first end portions 172 of the first and second brackets 158, 160 are also connected adjacent the right and left sides 164, 166 of the base 162, respectively. It is to be appreciated that the brackets may be formed integrally with the base or may be configured as separate members that can be connected with the base in various different ways, as discussed above.

As previously mentioned, the brackets 158, 160 of the second embodiment of the wipe container holder 116 have structural features 194 providing a keyed engagement with corresponding structural features 194' on the wipe container 118. More particularly, as shown in FIG. 7, the first end portions 172 of the first and second brackets 158, 160 include inwardly extending ledges 210 that define first and second recesses 212, 214, respectively. As such, the first end portions 172 of the first and second brackets 158, 160 flare outward away from each other to define an increased width between the first and second brackets adjacent the upper surface 184 of the base 162. The first and second recesses 212, 214 are adapted to engage and receive portions of the rim 136 adjacent the right side 124 and the left side 126 of the wipe container 118. The first and second brackets 158, 160 can be adapted to flex when placing the wipe container 118 on the base 162 to allow the rim 136 to "snap" into place within first and second recesses 212, 214. As such, the rim 136 on the wipe container 118 may act as the key member 196 and the recesses 212, 214 on the first and second brackets 158, 160 may act as the keyway 198. The keyed engagement between the wipe container holder 116 and the wipe container 118 may help ensure that a user does not replace the wipe container with a differently configured wipe container. The engagement between the key member 196 and the keyway 198 may also help a user to place the wipe container on the base in a particular orientation. Once the wipe container 118 is placed on the base 162, such as shown in FIG. 7, the engagement between the rim 136 and the ledges 192 of the brackets 158, 160 may also help resist forces exerted on the wipe container 118 in upward directions from the base 162, while at the same time allowing for relatively easy to removal and replacement of the wipe container.

Although the wipe container 118 is shown in FIG. 7 as having the key member 196 in the form of the outwardly extending rim 136 and the container holder 116 is shown as having the keyway 198 in the form of recesses 212, 214, it is to be appreciated that other configurations are possible. For example, in other embodiments, the wipe container may include one or more recessed areas adapted to receive corresponding protuberances on the brackets. It should also be appreciated that the wipe container and/or container holder may include one or more protuberances and/or recesses of various sizes that can be configured to define various different shapes. For example, the brackets can be configured with recesses that define concave surfaces adapted to closely correspond with the convex outline of the rim. In addition, the perimeter of the rim may be sized to define a relatively loose or snug fit within the recesses.

The wipe container holder 116 may also include other features adapted to engage the wipe container 118 to help hold the wipe container in position on the base. For example, as shown in FIGS. 7 and 8, the base 162 includes a forward ledge member 216 and a rear ledge member 218 adapted to engage the rim 136. As shown in FIG. 8, the forward ledge member 216 curves to extend forward and upward from the front side 168 of the base 162, and the rear ledge member 218 curves to extend rearward and upward from the rear side 170 of the base 162. As such, when the wipe container 118 is placed on the base 162, the forward ledge member 216 is adjacent a portion of the rim 136 extending along the front side 128 of the wipe container 118. Similarly, the rear ledge member 218 is adjacent a portion of the rim 136 extending along the rear side 130 of the container 118. As such, the forward and rear ledge members 216, 218 help prevent the wipe container from easily being moved in forward and rearward directions along the upper surface 184 of the base 162.

It is to be appreciated the first and second embodiments of wipe container holders described above include various features that may be used in various combinations. For example, the second embodiment of the wipe container holder and wipe container of FIGS. 7 and 8 may be configured to include the ledge and recess keyed engagement as described above with reference to the first embodiment of FIGS. 2-6. In another example, the ledge and recess keyed engagement described above with reference to the first embodiment of FIGS. 2-6 may also be used in combination with the forward and rear ledge members as well as the bracket recess/rim keyed engagement on the second embodiment of FIGS. 7 and 8. It is to be further appreciated that other embodiments may include various features not illustrated in the various figures. For example, the brackets may be configured to connect directly with a wall or other fixed object, as opposed to tissue trunnions. In other scenarios, the wipe container holder may include features that allow for height adjustments of the base. For example, some embodiments may include brackets and bases having adjustable lengths and/or widths. Other embodiments may include a base that is configured to connect with the brackets at various locations along the lengths of the brackets. Still other embodiments of the wipe container holder may be configured with brackets adapted to support the wipe container above the tissue trunnion. In yet other embodiments, the wipe container holder may be configured with a single bracket. The wipe container holder may also be supplied with a corresponding wipe container as kit. Further, the wipe container holder and wipe container may be displayed in a store in various ways that illustrate an intended use of the wipe container holder to consumers. For example, a store shelf display might include a shelf-mountable trunnion adapted to connect with a store shelf and support the wipe container holder and a corresponding wipe container thereon.

As previously mentioned, embodiments of the wipe container holder can also have various different characteristics that can help an individual being toilet trained to more easily learn to use wipes and/or conventional toilet paper. For example, as discussed above, the wipe container holder can be configured to support the wipes container at relatively low height and/or near a toilet to make it easier for a toddler to reach, extract, and use wipes from the wipe container while seated on a toilet. In other examples, embodiments of the wipe container holder can be configured with indicia or other aesthetically pleasing characteristics that may encourage and/or remind a youngster to wipe after using the toilet. In one scenario, the wipe container holder shown in FIG. 7 includes an image of an anthropomorphic frog. The frog may attract the attention of a youngster and provide a reminder to use the wipes. In another scenario, the wipe container holder can be provided with stickers or magnets that may be selectively affixed to the wipe container holder. The stickers or magnets may include various indicia signifying or corresponding with an individual's progress in the toilet training process. In yet another scenario, the wipe container holder can be reconfigurable to change form in accordance with an individual's success and/or progress in the toilet training process. For example, the wipe container holder can be provided with a group of figurines adapted to releasably connect with the wipe container holder and/or with each other. The different figurines can be connected with the wipe container to signify progress in the toilet training process. In one example, the figurines can be provided in different sizes, such as a family of bears. Younger/smaller bears can be displayed early in the toilet training process and older/larger bears can be later displayed to correspond with an individual's advancement in the toilet training process.

Embodiments of the wipe container holder can also provide various locations where different types of indicia such as designs, logos, letters, wording, and advertisements can be placed. For example, indicia may be disposed on the brackets and/or base to communicate information to a user. As used herein, the phrase "disposed on" is used to mean that the indicia are disposed on or otherwise provided with the wipe container holder. For example, the indicia may be printed directly on the outer surface of the wipe container holder, or printed on a separate substrate, such as a label that is affixed to the wipe container holder. The indicia may be applied using any known method, including printing. As used herein, the term "print" is intended to broadly cover all forms of forming visible marks on a wipe container holder, label, tag, or other substrate. The indicia can be selected to communicate information to a user. The information may relate to the general manner and/or desirability of using the wipes, or may provide instructional or descriptive information relating to other bathroom activities.

As used herein, the term "communicate" refers to the ability of indicia to impress an idea or message upon, or trigger a cognitive response within, a user. As such, communication may rely upon a user's experience or knowledge to arrive at the intended message. Additionally or alternatively, the indicia may illustrate simple concepts that are understood at a basic or visceral level that does not require the prior knowledge or experience of a user. In any event, the indicia is cognitively functional in that it conveys a message that is generally capable of being understood by a recipient user.

The indicia may be in the form of any visual communication suitable for communicating information regarding wipes and/or other bathroom accessories to a user. Accordingly, the indicia may include icons, which may comprise, but are not limited to, pictorial symbols, photographs, drawings, cartoons, and logos. For example, the icons may be provided as drawings of a child or an anthropomorphic image of an animal using the wipes and/or other bathroom accessories. Similarly, the icons may include well-known cartoon characters or brand logos, or characters specifically created to be associated with the wipes, for example. The icons may further include symbols, such as arrows, to indicate motion or movement.

The indicia may be arranged in any manner to communicate the desired information to a user. The indicia may be a single icon or a series of icons. Each icon may include one or more visual prompts. Where a series of icons are provided, the images may be arranged in any suitable fashion, such as, but not limited to, vertically, horizontally, diagonally, circular, and combination thereof.

The indicia may optionally include a character graphic that can increase a user's interest in the wipe container holder, wipe container, and/or wipes. The term "character graphic" is used herein to refer to a graphic containing an anthropomorphic image, and in particular an image having or suggesting human form or appearance which ascribes human motivations, characteristics or behavior to inanimate objects, animals, natural phenomena, toys, cartoon characters, or the like. The character graphic may be associated with popular characters in the media, advertising or well known in a particular culture. For example, the graphics can be associated with characters that the user, particularly a child, care about and want to identify with.

While some icons may illustrate how to use the wipe container holder, wipe container, and/or wipes, the icons need not instruct use of these accessories. In other embodiments, icons may further include numerical representations to identify the order in which to perform method steps shown in the icons. For example, a first icon may include a graphical representation which indicates that opening a toilet lid is a first step. A second icon may include a graphical representation indicating that sitting on the toilet is a second step. A third icon may include graphical representations indicating that extracting a wipe (or wipes) from a wipe container is a third step. A fourth icon may include graphical representations that wiping and discarding a wipe or toilet paper are fourth and fifth steps. A fifth icon may include a graphical representation indicating that flushing is a sixth step while a sixth icon may include a graphical representation indicating that closing the toilet lid and flushing the toilet are seventh and eighth steps.

As noted above, the indicia may be provided on the wipe container holder, wipe container, and/or individual wipes. As such, it will be appreciated that the indicia of these and other accessories may incorporate one or more common visual elements. For example, indicia may include common visual elements of an image of an anthropomorphic frog and an image of a toilet, among others. Furthermore, the common visual elements need not be identical in indicia on the wipe container holder, wipe container, and/or wipes, but instead may be merely similar. Examples of similar graphical representations that would be considered as illustrating a common visual element include similar icon themes (such as using non-identical images of an anthropomorphic frog), similar color schemes, or similar text fonts or syntax. Furthermore, while indicia on the wipe container holder, wipe container, and/or wipes may include a plurality of visual elements, only a single common visual element may be used to communicate the desired information to a user.

It is to be appreciated that indicia on the wipe container holder could correspond with a broader system of use of related accessories. For example, the frog (or other common indicia, iconography, instructions, etc.) may be provided on the wipes container and/or wipes, as well as other accessories relating to use in toilet training. Examples of such accessories may include a soap dispenser. In one scenario, the wipe container holder, the wipe container, wipes, and the soap dispenser may include indicia that illustrates and reinforces all of the steps of using a toilet, wiping, flushing, and washing hands. Other types of accessories could also be used in such a system.

The indicia disclosed herein are particularly suited for bathroom accessories intended for use by children. As such, the exemplary indicia illustrated herein are intended to be readily understandable by a pre-literate child. As used herein, the terms "pre-literate" and "incapable of reading" are used interchangeably to mean the inability of a child to correctly understand, comprehend and follow prompts written in a language that the child can speak without assistance of a caregiver. The ability of a child to recognize letters and/or read one or two isolated words still means that the child is "incapable of reading" since he or she is unable to understand, comprehend and follow such written prompts, without assistance. However, this definition of "incapable of reading" does not exclude the child from being able to understand, comprehend and follow visual prompts which are presented in the form of drawings, icons, symbols, gestures, cartoons and the like. Furthermore, while the disclosed embodiments are capable of being understood by a pre-literate child, it is not necessary for the indicia to be understood at this level.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bathroom accessory comprising:

a means for supporting a wipes container;

an aperture in the means for supporting a wipes container;

a first member connected with the means for supporting a wipes container;

a first means for connecting the first member with a bathroom tissue roll trunnion;

a second member connected with the means for supporting a wipes container;

a second means for connecting the second member with a bathroom tissue roll trunnion; and a means for engaging a wipes container while supported on the base means and covering the aperture.

2. The bathroom accessory of claim 1, wherein the means for engaging a wipes container comprises a structural feature adapted to provide a keyed engagement with a corresponding structural feature on a wipes container.

3. The bathroom accessory of claim 2, wherein the structural feature comprises a ledge defining a rectangular-shaped perimeter surrounding the aperture.

4. The bathroom accessory of claim 1, wherein the means for engaging a wipes container comprises a keyway.

5. The bathroom accessory of claim 4, wherein the keyway comprises a first recess in the first member and a second recess in the second member.

6. The bathroom accessory of claim 1, wherein the first means for connecting the first member with a bathroom tissue roll trunnion and the second means for connecting the second member with a bathroom tissue roll trunnion comprise first and second hooks, each having a closed perimeter defining apertures in the first and second members.

7. A bathroom accessory comprising:

a means for supporting a wipes container;

an aperture in the means for supporting a wipes container;

a first member connected with the means for supporting a wipes container;

a first means for connecting the first member with a bathroom tissue roll trunnion;

a second member connected with the means for supporting a wipes container;

a second means for connecting the second member with a bathroom tissue roll trunnion; and a means for preventing movement of a wipes container in at least one direction while supported on the base means and covering the aperture.

8. The bathroom accessory of claim 7, further comprising a key member adapted to provide a keyed engagement with a corresponding structural feature on a wipes container.

9. The bathroom accessory of claim 8, further comprising a keyway adapted to provide a keyed engagement with a corresponding structural feature on a wipes container.

10. The bathroom accessory of claim 9, wherein the at least one keyway comprises:

a first recess in the first member; and a second recess in the second member.

11. The bathroom accessory of claim 7, wherein the aperture is surrounded by the means for preventing movement of a wipes container.

12. The bathroom accessory of claim 7, wherein the means for preventing movement of a wipes container comprises a structural feature adapted to provide a keyed engagement with a corresponding structural feature on a wipes container.

13. The bathroom accessory of claim 12, wherein the structural feature comprises a ledge.

14. The bathroom accessory of claim 7, wherein the means for preventing movement of a wipes container comprises a key member and a keyway.

* * * * *